United States Patent [19]

Sasaki et al.

[11] Patent Number: 4,767,320

[45] Date of Patent: Aug. 30, 1988

[54] AUTOMATICALLY FLOW CONTROLLED CONTINUOUS HEAT TREATING FURNACE

[75] Inventors: Hirofumi Sasaki, Osaka; Yoshinaga Miyabe, Nishinomiya, both of Japan

[73] Assignee: Chugai Ro Co., Ltd., Osaka, Japan

[21] Appl. No.: 114,070

[22] Filed: Oct. 29, 1987

[51] Int. Cl.[4] ..... F27B 9/28

[52] U.S. Cl. ..... 432/59; 432/72; 432/152; 432/176

[58] Field of Search ..... 432/8, 59, 72, 152, 432/176, 199

[56] References Cited

U.S. PATENT DOCUMENTS

| | | | |
|---|---|---|---|
| 3,601,375 | 8/1971 | Bowman | 432/152 |
| 4,021,192 | 5/1977 | Ferguson et al. | 432/72 |
| 4,198,764 | 4/1980 | Ellison et al. | 432/59 |
| 4,217,090 | 8/1980 | Whike et al. | 432/59 |
| 4,285,669 | 8/1981 | Walchhutter | 432/176 |
| 4,326,342 | 4/1982 | Schregenberger | 432/59 |
| 4,527,974 | 7/1985 | Carraroli et al. | 432/176 |
| 4,715,810 | 12/1987 | Ramsey et al. | 432/72 |

*Primary Examiner*—Henry C. Yuen

*Attorney, Agent, or Firm*—Wenderoth, Lind & Ponack

[57] ABSTRACT

A continuous heat treating furnace is equipped with an automatic flow control system and contains a high-temperture treating zone internally provided with a plurality of burners, a pre-heating zone connectively disposed at one end of the high-temperature treating zone and a cooling zone connectively disposed at its other end, the pre-heating and cooling zones being partitioned into a plurality of compartments each provided on its ceiling portion with a convection fan. The automatic flow control system includes a first duct for communicating a terminal compartment of the pre-heating zone and a first compartment of the cooling zone, a second duct for communicating a terminal compartment of the cooling zone and a first compartment of the pre-heating zone, a first flow regulating damper disposed in the course of the first duct to regulate a flow rate of atmosphere gas flowing in the first duct, and a second flow regulating damper disposed in the course of the second duct to regulate the flow rate of the atmosphere gas flowing in the second duct. By such an arrangement, the flow rate of the atmosphere gas introduced into the pre-heating zone and that introduced into the cooling zone are automatically regulated to coincide with each other.

2 Claims, 3 Drawing Sheets

AUTOMATICALLY FLOW CONTROLLED CONTINUOUS HEAT TREATING FURNACE

BACKGROUND OF THE INVENTION

1. Field of the Invention

The present invention generally relates to a continuous heat treating furnace and more particularly, to a heat-exchanging type continuous heat treating furnace equipped with an automatic flow control system in which energy-saving measures are fully conducted.

2. Description of the Prior Art

Conventionally, in a continuous heat treating furnace having a pre-heating zone, a high-temperature treating zone and a cooling zone, various attempts have been proposed to promote energy-saving.

Japanese Patent Publication (Tokkosho) No. 45-10610 discloses one of the continuous heat treating furnaces which is arranged substantially in the form of a figure "U" so that the pre-heating and cooling zones may be disposed in a parallel relationship to each other, with a partition wall spaced from a ceiling wall being interposed between both zones. Such an arrangement enables heat-exchange between the pre-heating and cooling zones.

The continuous heat treating furnace of the above described type is, however, disadvantageous in that since atmosphere gas in one zone i.e., in the pre-heating or the cooling zone is mixed therein, a large temperature difference between the atmosphere gas and a workpiece to be treated can not be obtained and accordingly, heat-exchanging efficiency is undesirably low.

U.S. Pat. No. 4,449,923 (corresponding to Japanese Patent Application No. 56-13126) and Japanese Patent Application No. 56-182515, both proposed by the same applicant of the present invention, were developed to eliminate the above described disadvantage.

In the former, the pre-heating and cooling zones are united into one and a charge end portion of the pre-heating zone and a discharge end portion of the cooling zone are communicated with each other through a recirculation duct provided outside the furnace so that high-temperature atmosphere gas contained in the high-temperature treating zone may be caused to pass through the pre-heating zone to pre-heat the workpiece to be treated while the atmosphere gas which has been lowered in temperature through the heatexchange with the workpiece is circulated back to the hightemperature treating zone.

Even in this kind of the furnace, since the temperature of the atmosphere gas is substantially leveled throughout the pre-heating and cooling zones, an average temperature difference between the atmosphere gas and the workpiece is relatively small. As a result, it is disadvantageously difficult not only to render an end temperature of the workpiece by the pre-heating or by the cooling to a desired one, but also to keep a predetermined cooling rate with respect to the workpiece.

The latter is of a construction such that both of the pre-heating and cooling zones are separated into a plurality of compartments each accommodating a convection fan on its ceiling portion while a terminal compartment of the pre-heating zone is communicated with a first compartment of the cooling zone through a duct so that the atmosphere gas in the cooling zone may be drawn into the terminal compartment of the pre-heating zone and further towards a first compartment thereof.

Hereupon, a flow rate of the atmosphere gas flowing from the pre-heating zone towards the cooling zone or from the cooling zone towards the pre-heating zone is inversely proportional to an absolute temperature of the atmosphere gas in the zone from which the atmosphere gas is supplied, that is, the absolute temperature of the atmosphere gas in the pre-heating zone in the case where the atmosphere gas is supplied from the pre-heating zone towards the cooling zone or that in the cooling zone in the case where the atmosphere gas is supplied from the cooling zone towards the pre-heating zone. In particular, since the temperature of the atmosphere gas in the pre-heating zone varies greatly according to the presence of the workpiece to be treated, the flow rate of the atmosphere gas to be supplied from the pre-heating zone towards the cooling zone also greatly varies.

The terms "flow rate" used hereinbefore and hereinafter are to be understood as meaning of a gas volume flowing in a unit period under a standard state at 0° C. and 1 atm.

In either of the above described constructions, since the flow rate of the atmosphere gas supplied through the duct changes, the atmosphere gas in the pre-heating zone or in the cooling zone is introduced into the heating zone. Consequently, the atmosphere gas drawn into the heating zone is unnecessarily uneconomically heated therein.

SUMMARY OF THE INVENTION

Accordingly, the present invention has been developed with a view to substantially eliminating the above described disadvantages inherent in the prior art continuous heat treating furnace, and has for its essential object to provide an improved continuous heat treating furnace equipped with an automatic flow control system which is fully conducive to energy-saving.

To this end, there is provided, according to the present invention, an improved continuous heat treating furnace equipped with an automatic flow control system, having a high-temperature treating zone internally provided with heating means, a pre-heating zone connectively disposed at one end of the high-temperature treating zone and a cooling zone connectively disposed at the other end thereof, the pre-heating and cooling zones being partitioned into a plurality of compartments each provided on its ceiling portion with a convection fan. The automatic flow control system includes a first duct means for communicating a terminal compartment of the pre-heating zone and a first compartment of the cooling zone, a second duct means for communicating a terminal compartment of the cooling zone and a first compartment of the pre-heating zone, a first flow regulating means disposed in the course of said first duct means to regulate a flow rate of atmosphere gas flowing in said first duct means, and a second flow regulating means disposed in the course of said second duct means to regulate the flow rate of the atmosphere gas flowing in said second duct means. By such an arrangement, the flow rate of the atmosphere gas introduced into the pre-heating zone and that introduced into the cooling zone are automatically regulated to coincide with each other.

The second duct means in the above described arrangement may be replaced by another duct means connected at its one end to the terminal compartment of the cooling zone and at its other end to a fan or a blower so that ambient air may be supplied from the fan into the cooling zone to cool a workpiece heat-treated in the furnace.

BRIEF DESCRIPTION OF THE DRAWINGS

This and other objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENT

Figure 1:
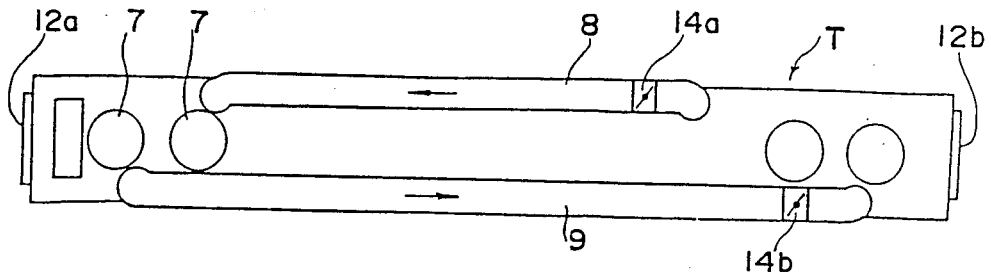
FIG. 1 is a top plan view of a heat-exchanging type continuous heat treating furnace equipped with an automatic flow control system according to a first preferred embodiment of the present invention.
Figure 2:
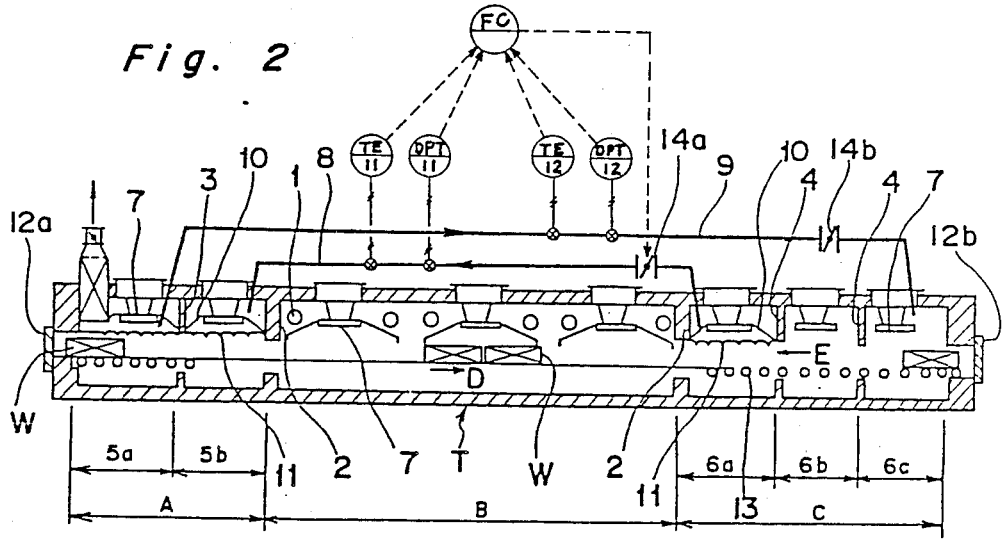
FIG. 2 is a vertical sectional schematic diagram of FIG. 1.
Figure 3:
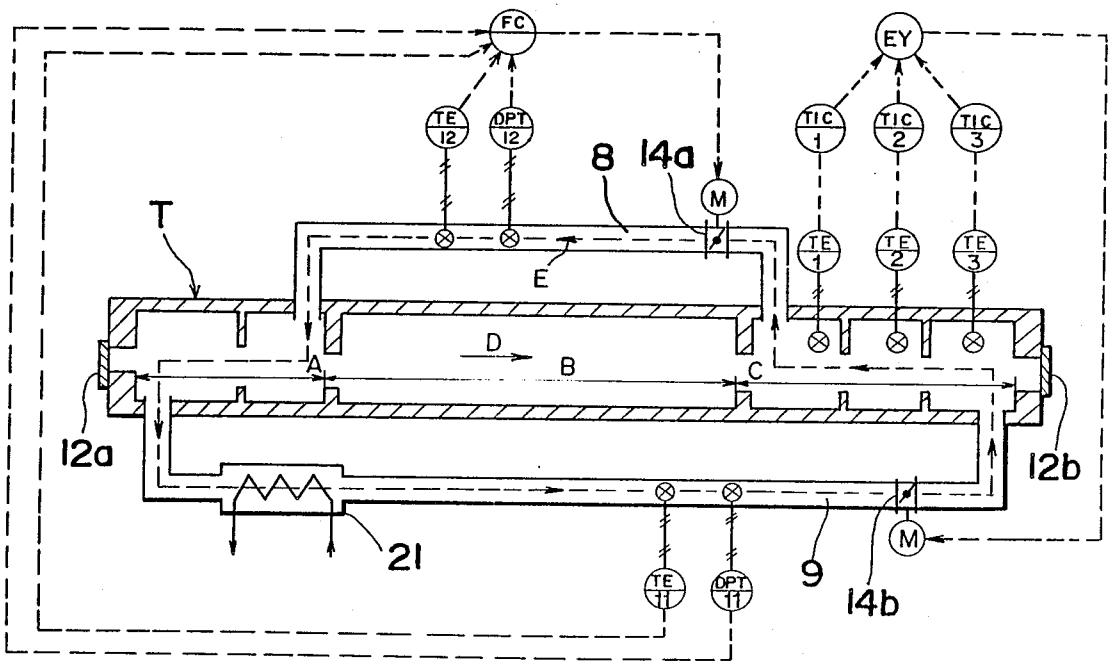
FIG. 3 is a schematic diagram of the automatic flow control system employed in the continuous heat treating furnace of FIG. 1.

Referring now to the drawings, there is shown in FIGS. 1, 2 and 3, a heat-exchanging type continuous heat treating furnace T according to a first embodiment of the present invention, which is generally provided with a pre-heating zone A, a heating zone B and a cooling zone C, with these three zones A, B and C being separated from each other by two separating walls 2. The pre-heating zone A is further partitioned into two compartments, a first compartment 5*a* and a second compartment 5*b*, by a partition wall 3, and similarly, the cooling zone C is partitioned into three compartments, a first compartment 6*a*, a second compartment 6*b* and a third compartment 6*c*, by two partition walls 4, with a recirculation or convection fan 7 being disposed in each of the partitioned compartments 5*a*, 5*b*, 6*a*, 6*b* and 6*c*. The heating zone B is of a high-temperature treating zone accommodating a plurality of direct firing type burners 1 and a plurality of recirculation or convection fans 7. A series of transport rollers 13 are rotatably disposed within the furnace to transport a workpiece W to be treated therein in a direction as shown by an arrow D. The furnace is further provided with a charge door 12*a* through which the workpiece W is charged into the furnace and a discharge door 12*b* through which the workpiece W is discharged from the furnace after the heat treatment.

The second compartment 5*b* which is the terminal compartment of the pre-heating zone A is communicated with the first compartment 6*a* of the cooling zone C through a first duct 8, and likewise, the first compartment 5*a* of the pre-heating zone A is communicated, through a second duct 9, with the third compartment 6*c* which is the terminal compartment of the cooling zone C, with a couple of gas flow control dampers 14*a* and 14*b* being disposed in the first and second ducts 8 and 9, respectively. The atmosphere gas circulates in a direction as shown by an arrow E through the first compartment 6*a* of the cooling zone C, the first duct 8, the second compartment 5*b* of the pre-heating zone A, the first compartment 5*a* of the pre-heating zone A, the second duct 9, the third compartment 6*c* of the cooling zone C and the second compartment 6*b* of the cooling zone C in this sequence and returns into the first compartment 6*a* of the cooling zone C.

In the continuous heat treating furnace having the above described construction, the flow rate of the atmosphere gas is automatically regulated by the first and second dampers 14*a* and 14*b* coupled to respective electric motors M, as shown in FIG. 3.

More specifically, three thermo-sensors TE1, TE2 and TE3 such as thermocouples or the like are provided in respective compartments 6*a*, 6*b* and 6*c* of the cooling zone C to detect temperature of the atmosphere gas within these compartments 6*a*, 6*b* and 6*c*. The thermo-sensors TE1, TE2 and TE3 are electrically connected to respective temperature indicating controllers TIC1, TIC2 and TIC3 to send electric signals thereto, while these three temperature indicating controllers TIC1, TIC2 and TIC3 are also electrically connected to one comparator EY to output respective voltage signals thereinto. The maximum one in these three signals outputted from the temperature indicating controllers TIC1, TIC2 and TIC3 is compared with a reference voltage in the comparator EY to control the second electric motor M drivingly coupled to the second damper 14*b* so that an opening of the second damper 14*b* disposed in the course of the second duct 9 may be regulated thereby.

In addition, the first and second ducts 8 and 9 are each provided with a thermo-sensor TE11 or TE12 for detecting the temperature of the atmosphere gas flowing therein and a differential pressure transmitter DPT11 or DPT12 for detecting a flow speed of the atmosphere gas, the thermo-sensors TE11 and TE12 and the differential pressure transmitters DPT11 and DPT12 being electrically coupled to one flow arithmetic controller FC to output voltage signals thereinto. A product of two outputs from the thermo-sensor TE11 and the differential pressure transmitter DPT11 is compared with that of other two outputs from the thermo-sensor TE12 and the differential pressure transmitter DPT12 in the flow arithmetic controller FC so that an opening of the first damper 14*a* may be regulated by the first electric motor M drivingly coupled thereto in accordance with a result obtained through the comparison in the flow arithmetic controller FC.

In this embodiment, the first and second compartments 5*a* and 5*b* of the pre-heating zone A and the first compartment 6*a* of the cooling zone C each accommodate a hood 10 defining a plurality of nozzle openings 11 for jets in its lower surface. The atmosphere gas within the furnace is caused to circulate through the first and second ducts 8 and 9 in the aforegoing direction under the influence of positive pressure inside the hoods 10 and negative pressure outside the hoods 10 produced by the recirculation fans 7, with opposite ends of the first duct 8 being open outside the hoods 10 and one end of the second duct 9 being open inside the hood 10 in the first compartment 5*a* of the pre-heating zone A. It goes without saying that a blower or blowers may be additionally provided in the course of the first and/or second ducts 8 and/or 9, as occasion demands.

Accordingly, the workpiece W charged into the pre-heating zone A through the charge door 12*a* is pre-heated in the first compartment 5*a* by the atmosphere gas of approximately 510° C. supplied from the second compartment 5*b*, in which the workpiece W is further pre-heated by mixed gas of around 600° C. which is of the high-temperature atmosphere gas from the first compartment 6a of the cooling zone C and combustion gas from the heating zone B. The workpiece W is then transported into the heating zone B in which it is heated up to approximately 720° C.

Thereafter, the workpiece W treated in the heating zone B is cooled down in the first compartment 6a of the cooling zone C by the atmosphere gas of relatively low temperature of 420° C. fed from the second compartment 6b. In the first compartment 6a, the temperature of the atmosphere gas is raised to approximately 550° C. by the workpiece W heated up to approximately 720° C. in the heating zone B, until the workpiece W is transported into the second compartment 5b of the pre-heating zone A.

The workpiece W is then similarly cooled down in accordance with a predetermined cooling curve in the second and third compartments 6b and 6c of the cooling zone C, until it is discharged therefrom through the discharge door 12b.

Figure 4:
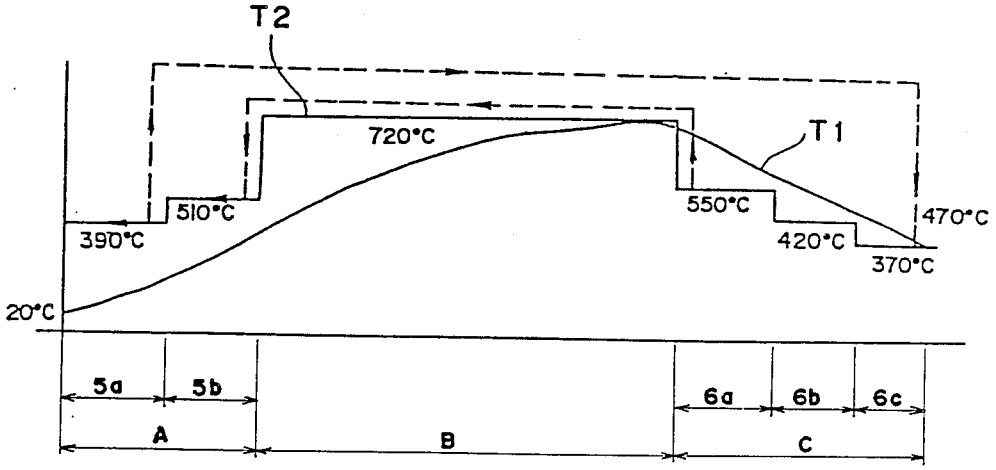
FIG. 4 is a graph showing a relationship between the temperature of a workpiece to be treated and that of atmosphere gas in each of compartments or zones provided in the continuous heat treating furnace of FIG. 1.

FIG. 4 illustrates the temperature T1 of the workpiece W and the temperature T2 of the atmosphere gas in each of the compartments or zones in the above described case.

The automatic flow control system of the atmosphere gas will be henceforth described in detail.

The electrically controlled first and second dampers 14a and 14b regulate the atmosphere gas circulating in the first and second ducts 8 and 9 so that the flow rate thereof in the first duct 8 may be identical with that in the second duct 9. Such a regulation is executed through measurement of the flow rate of the atmosphere gas upon detection of the flow speed and the temperature thereof in the first and second ducts 8 and 9.

The automatic control of the flow rate is generally based on either one of two flow rates in the first and second ducts 8 and 9, and the other one is controlled so as to be indentical with the basic one.

There is no question that two flow rates may be independently controlled to a predetermined one.

In the case as shown in FIGS. 1, 2 and 3, the flow rate in the first duct 8 is controlled on the basis of that in the second duct 9. In this case, since a treatment temperature and a cooling rate of the workpiece W are always constant, the temperature of the atmosphere gas in the first compartment 6a of the cooling zone C is kept constant. Accordingly, if the second damper 14b in the second duct 9 is primarily set to permit the atmosphere gas to flow at a predetermined flow rate, the flow rate would not change in the second duct 9 from that time on. Therefore, when the flow rate in the first duct 8 is controlled to be identical with that in the second duct 9, the heat-exchange can be effectively executed between the workpiece W and the atmosphere gas.

Whenever conditions for heat treatment such as the treatment temperature, the cooling rate or the like, or production capacity of the workpiece W changes, the workpiece W dissipates different energy of heat in the cooling zone C. Depending upon circumstances, the temperature of the atmosphere gas in the cooling zone C may be required to be changed. In certain cases like this, it is necessary to regulate the flow rate of the atmosphere gas flowing within the cooling zone C so as to correspond to the energy of heat dissipated from the workpiece W in order to effectively collect it.

The control of the flow rate of the atmosphere gas as shown in FIGS. 1, 2 and 3 is based on the above described idea or notion.

In this embodiment, the temperature within the cooling zone C is automatically controlled so that the workpiece W may be cooled in accordance with a predetermined cooling rate. To this end, the opening of the second damper 14b is controlled by a signal sent from the comparator EY so that the flow rate of the atmosphere gas may become an optimum one. Namely, since the energy of heat dissipated from the workpiece W reduces with reduction of the production capacity, the temperature inside the cooling zone C tends to be lowered. Accordingly, the second damper 14b is closed by either one of the signals sent from the temperature indicating controllers TIC1, TIC2 and TIC3 so that the flow rate of the low temperature atmosphere gas supplied from the pre-heating zone A towards the terminal compartment 6c of the cooling zone C may be caused to reduce.

On the contrary, since the energy of heat dissipated from the workpiece W increases with increase of the production capacity, the temperature inside the cooling zone C tends to go up. Consequently, the second damper 14b is further opened to raise the flow rate of the atmosphere gas.

In a manner as described above, the flow rate of the circulating atmosphere gas can be controlled in compliance with the energy of heat dissipated from the workpiece W in the cooling zone C, thus resulting in that the energy of heat can be effectively collected even in a furnace having a largely fluctuating production capacity.

In this embodiment, since the flow rate of the atmosphere gas circulating from the pre-heating zone A towards the cooling zone C through the second duct 9 is automatically controlled in compliance with the production capacity, the flow rate of the atmosphere gas flowing from the cooling zone C towards the pre-heating zone A through the first duct 8 is also controlled so as to coincide with that of the former.

It is to be noted that in this embodiment, although the flow rate of the atmosphere gas is controlled by a signal sent from the zone in which the largest fluctuation has taken place through comparison among three signals outputted from three sets of the temperature indicating controllers TIC1, TIC2 and TIC3, the second damper 14b may be regulated only by one temperature indicating controller corresponding to the zone which was known in advance that the maximum energy of heat would be dissipated from the workpiece therein, or in which the cooling required for the heat treatment would be substantially completed.

It is further to be noted that, as shown in FIG. 3, a cooling means 21 for cooling the atmosphere gas to be fed into the third compartment 6c of the cooling zone C may be provided in the course of the second duct 9 as occasion demands.

Figure 5:
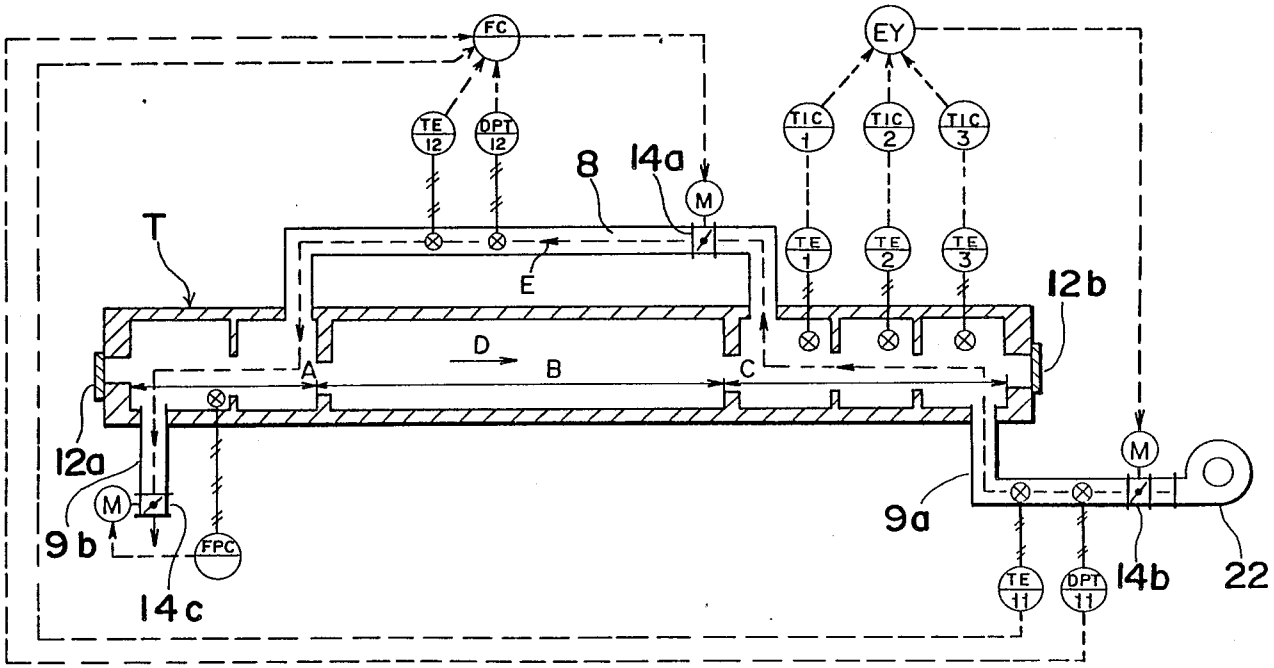
FIG. 5 is a diagram similar to FIG. 3, according to a second preferred embodiment of the present invention.

FIG. 5 illustrates the automatic flow control system for the continuous heat treating furnace according to a second preferred embodiment of the present invention.

In FIG. 5, there is provided a second duct 9a communicating the third compartment 6c of the cooling zone C and a fan 22 or a blower so that ambient air may be supplied from the fan 22 into the third compartment 6c of the cooling zone C. Accordingly, the second duct 9 of the first embodiment communicating the first compartment 5a of the pre-heating zone A and the terminal third compartment 6c of the cooling zone C is removed from the furnace of this embodiment. The thermo-sensor TE11 and the differential pressure transmitter DPT11 are also provided in the course of the second duct 9a to control the first damper 14a in compliance with the flow rate of the air supplied from the fan 22 through the second damper 14b.

Furthermore, there is provided, in this embodiment, a third duct 9b communicating with the first compartment 5a of the pre-heating zone A and provided with a third damper 14c at its open end. A furnace pressure controller FPC is provided in the first compartment 5a of the pre-heating zone A and electrically connected to an electric motor M coupled to the third damper 14c so that the pressure inside the furnace may be controlled to a predetermined one by the third damper 14c. This kind of the furnace pressure controller FPC is generally provided in the conventional combustion furnace and may be installed in the first embodiment.

It is to be noted that the aforementioned direct firing type burners 1 may be replaced by heating members such as radiant tubes of indirect heating means or the like.

It is also to be noted that in the above described embodiments, although the first, second and third dampers 14a, 14b and 14c are electrically controlled by the electric motors M, they may be replaced by hydraulically or pneumatically controlled dampers or the like.

As clearly described so far, according to the present invention, the atmosphere gas which has been heated up to a certain high temperature through the cooling of the high-temperature workpiece W transported from the high-temperature treating zone B into the cooling zone C, is caused to flow from the first compartment 6a of the cooling zone C towards the terminal compartment 5b of the pre-heating zone A through the first duct 8 so that the workpiece W may be pre-heated by the atmosphere gas flowing in a direction opposite to the direction in which the workpiece W is transported, with the convection being imparted to the atmosphere gas by the convection fans 7. Furthermore, both of the pre-heating and cooling zones A and C are partitioned into several compartments each having a convection fan 7 on its ceiling portion. Accordingly, since the atmosphere gas in one compartment is substantially not mixed with that in adjacent compartment, the temperature of the atmosphere gas in each compartment is always higher or lower than that of the workpiece W, thus resulting in that the heat-exchange between the two can be effectively executed and this fact is greatly conducive to the energy-saving.

In addition, the second duct 9 or 9a connected at its one end to the terminal compartment 6c of the cooling zone C is provided, in the course thereof, with the automatically controlled second damper 14b for regulating the flow rate of the atmosphere gas or air flowing in the second duct 9 or 9a to a predetermined one. The first duct 8 communicating the first compartment 6a of the cooling zone C and the terminal compartment 5b of the pre-heating zone A is also provided with the automatically controlled first damper 14a by which the flow rate of the atmosphere gas flowing in the first duct 8 is regulated to coincide with that flowing in the second duct 9 or 9a. By such a construction, excessive atmosphere gas never be introduced into the heating zone B, thus promoting the energy-saving, since no excessive atmosphere gas never be heated in the heating zone B.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. In a heat-exchanging type continuous heat treating furnace having a high-temperature treating zone internally provided with heating means, a pre-heating zone connectively disposed at one end of the high-temperature treating zone and a cooling zone connectively disposed at the other end thereof, the pre-heating and cooling zones being partitioned into a plurality of compartments each provided on its ceiling portion with a convection fan, an automatic flow control system comprising:

a first duct means for communicating a terminal compartment of the pre-heating zone and a first compartment of the cooling zone;

a second duct means for communicating a terminal compartment of the cooling zone and a first compartment of the pre-heating zone;

a first flow regulating means disposed in the course of said first duct means to regulate a flow rate of atmosphere gas flowing in said first duct means; and a second flow regulating means disposed in the course of said second duct means to regulate the flow rate of the atmosphere gas flowing in said second duct means;

whereby the flow rate of the atmosphere gas introduced into the pre-heating zone and that introduced into the cooling zone are automatically regulated to coincide with each other.

2. In a heat-exchanging type continuous heat treating furnace having a high-temperature treating zone internally provided with heating means, a pre-heating zone connectively disposed at one end of the high-temperature treating zone and a cooling zone connectively disposed at the other end thereof, the pre-heating and cooling zones being partitioned into a plurality of compartments each provided on its ceiling portion with a convection fan, an automatic flow control system comprising:

a first duct means for communicating a terminal compartment of the pre-heating zone and a first compartment of the cooling zone;

a second duct means connected at its one end to a terminal compartment of the cooling zone to supply ambient air into the cooling zone therethrough;

a first flow regulating means disposed in the course of said first duct means to regulate a flow rate of atmosphere gas flowing in said first duct means; and a second flow regulating means disposed in the course of said second duct means to regulate the flow rate of the air flowing in said second duct means;

whereby the flow rate of the atmosphere gas introduced into the pre-heating zone and the flow rate of the air introduced into the cooling zone are automatically regulated to coincide with each other.

* * * * *